US005700967A

United States Patent [19]

Gühring

[11] Patent Number: 5,700,967

[45] Date of Patent: Dec. 23, 1997

[54] INTERLOCKING MECHANISM FOR A SELF-LOADING WEAPON

[75] Inventor: Manfred Gühring, Beffendorf, Germany

[73] Assignee: Heckler & Koch GmbH, Germany

[21] Appl. No.: 762,378

[22] Filed: Dec. 6, 1996

[30] Foreign Application Priority Data

Dec. 7, 1995 [DE] Germany ..... 195 45 774.9

[51] Int. Cl.[6] ..... F41A 17/00; F41A 7/00

[52] U.S. Cl. ..... 89/1.42; 89/11

[58] Field of Search ..... 89/1.42, 9, 11

[56] References Cited

U.S. PATENT DOCUMENTS

| | | | |
|---|---|---|---|
| 3,786,716 | 1/1974 | Wilson | 89/9 X |
| 5,225,625 | 7/1993 | Rochelle et al. | 89/9 |
| 5,231,243 | 7/1993 | Lescure | 89/9 |

FOREIGN PATENT DOCUMENTS

| | | |
|---|---|---|
| 501820 | 7/1930 | Germany . |
| 309602 | 9/1955 | Netherlands . |

*Primary Examiner*—Michael J. Carone
*Assistant Examiner*—Matthew J. Lattig
*Attorney, Agent, or Firm*—Leydig, Voit & Mayer, Ltd.

[57] ABSTRACT

A self-loading weapon includes a bolt and a tension slide slidably mounted in the housing of the weapon, and an interlocking mechanism for securely locking the tension slide in its front end position during the shooting operation of the weapon. The interlocking mechanism comprises an angled lever which is pivotally connected to the tension slide. One arm of the angled lever is formed as a hand grip protruding from the weapon for manually moving the tension slide and the breech block. A second arm of the angled lever has a latch formed thereon for engaging a stop formed in the housing when the tension slide is in its front end position to prevent the tension slide from rearward movement.

10 Claims, 1 Drawing Sheet

INTERLOCKING MECHANISM FOR A SELF-LOADING WEAPON

FIELD OF THE INVENTION

This invention relates generally to the weaponry art, and more particularly to an interlocking mechanism used in a self-loading weapon for retentively engaging a tension slide mechanism in a desired position thereby preventing interference with other components of the weapon.

BACKGROUND OF THE INVENTION

Certain types of self-loading weapons, such as submachine guns, have a firing mechanism that includes a tension slide element that coacts with a breech block or bolt when loading of the weapon is initiated. Both of these components are guided for sliding movement by a longitudinally extending guide disposed in the housing of the weapon. The tension slide element is disposed in front of the bolt and has a hand grip attached thereto which protrudes outwardly from the housing of the weapon. The bolt is normally biased in contacting relation against the tension slide element in a forward position of the weapon by a recoil spring. The bolt is moved from its forward position to a rearward position by pulling the hand grip toward the rear end of the weapon to move the tension slide element and bolt together in the rear direction. When the bolt reaches a rear position, the hand grip is released, and the recoil spring moves the bolt forward, which in turn pushes the tension slide element forward until it abuts a front end stop. This prevents forward movement of the tension slide element in the forward position once it has moved into that position.

In a known design of an "up-shooting"-type submachine gun with the general construction described above, the tension slide element is provided with a spring loaded detent lug adapted to hold the tension slide in its forward position. The detent spring grips behind the housing component which serves as the front end stop for the tension slide element. The term "upshooting" as used herein means that the bolt or breech block of the submachine gun returns to the forward position after delivering a shot.

In this submachine gun design, the tension slide element has a hand grip that protrudes from the housing of the weapon. The hand grip remains fixed in the front position during the firing of the weapon, but can be grasped readily for the manual loading (or charging) of the weapon. This loading arrangement is desirable in view of the requirements for firearms used by police, according to which the firearms should be carried unloaded as much as possible.

In order to load such a submachine gun, the hand grip on the tension slide element is gripped by the left or non-trigger hand of the user to overcome the detent holding it. The tension slide element is drawn rearward until it engages a stop, and is thereafter released. In this process, the bolt is moved back together with the tension slide element and then returned to its forward position to execute the regular reloading operation. After reloading, the tension slide element is held in its front end position by the above described detent lug to prevent interference with the movement of the bolt caused by the firing of cartridges.

The self-loading of such a submachine gun often becomes jammed during the firing of the weapon. It has been found that jamming is largely due to unintended release of the tension slide element from its front end position caused by the forces generated in the firing operation. When the tension slide element is jarred from its intended position, it blocks or otherwise interferes with the stroke action of the bolt and thus causes jamming.

SUMMARY OF THE INVENTION

In view of the foregoing, it is a primary object of the present invention to provide a self-loading weapon that effectively reduces the occurrences of jamming.

It is a related object of the present invention to provide such a self-loading weapon with a tension slide element having an interlocking mechanism that is simple in construction and reliable in operation.

In accordance with these and other objects of the present invention, a self-loading weapon includes a bolt or breech block and a tension slide element received for sliding movement in a longitudinally extending guide disposed in the weapon housing. The tension slide element has a hand lever which is pivotally mounted thereon for releasably interlocking the tension slide element in a front end position. A recoil spring is coupled to the bolt for normally biasing the bolt in pushing engagement with the tension slide element in the forward position.

The hand lever also has a hand grip protruding from the housing. When the tension slide element is in its forward position, the hand lever is pivotable into a latched position. In the latched position, a latch disposed on the hand lever opposite to the hand grip engages a stop formed in the housing of the weapon to prevent the rearward movement of the tension slide element. When the hand lever is counter-rotated to an unlatched position, the latch is disengaged from the housing stop to permit sliding movement of the tension slide in the rear direction.

Other objects and advantages will become apparent with reference to the following detailed description when taken in conjunction with the drawing in which:

DETAILED DESCRIPTION OF THE PREFERRED EMBODIMENT

Generally, the present invention relates to an interlocking device for a tension slide element used in conjunction with a bolt to permit reliable operation of a weapon. In a first position, the interlocking device retains the tension slide member in place to permit unobstructed movement of the bolt.

Figure 1:
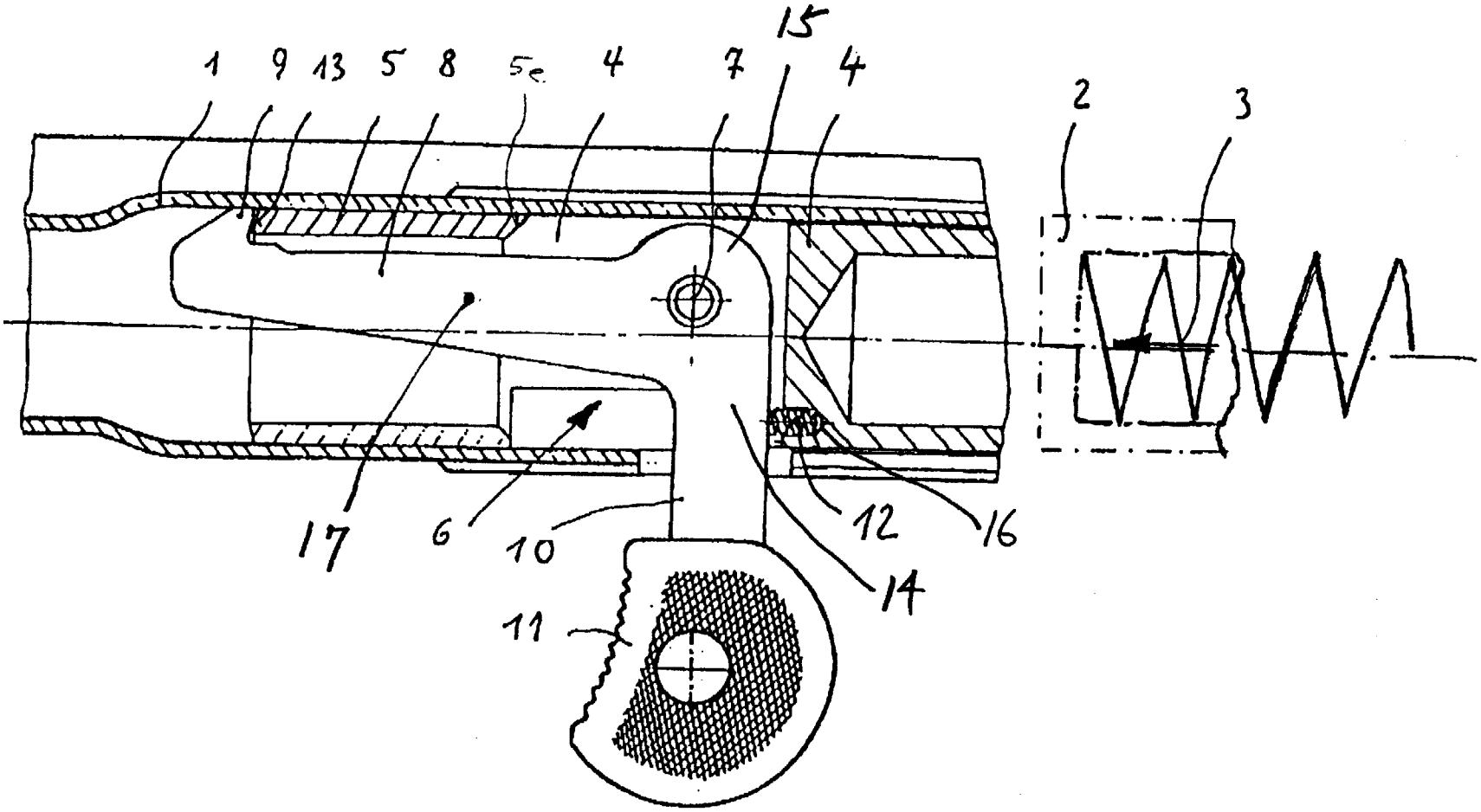
FIG. 1 is a fragmentary cross sectional view of a submachine gun, viewed from the top of the weapon, according to the present invention.
Figure 1:
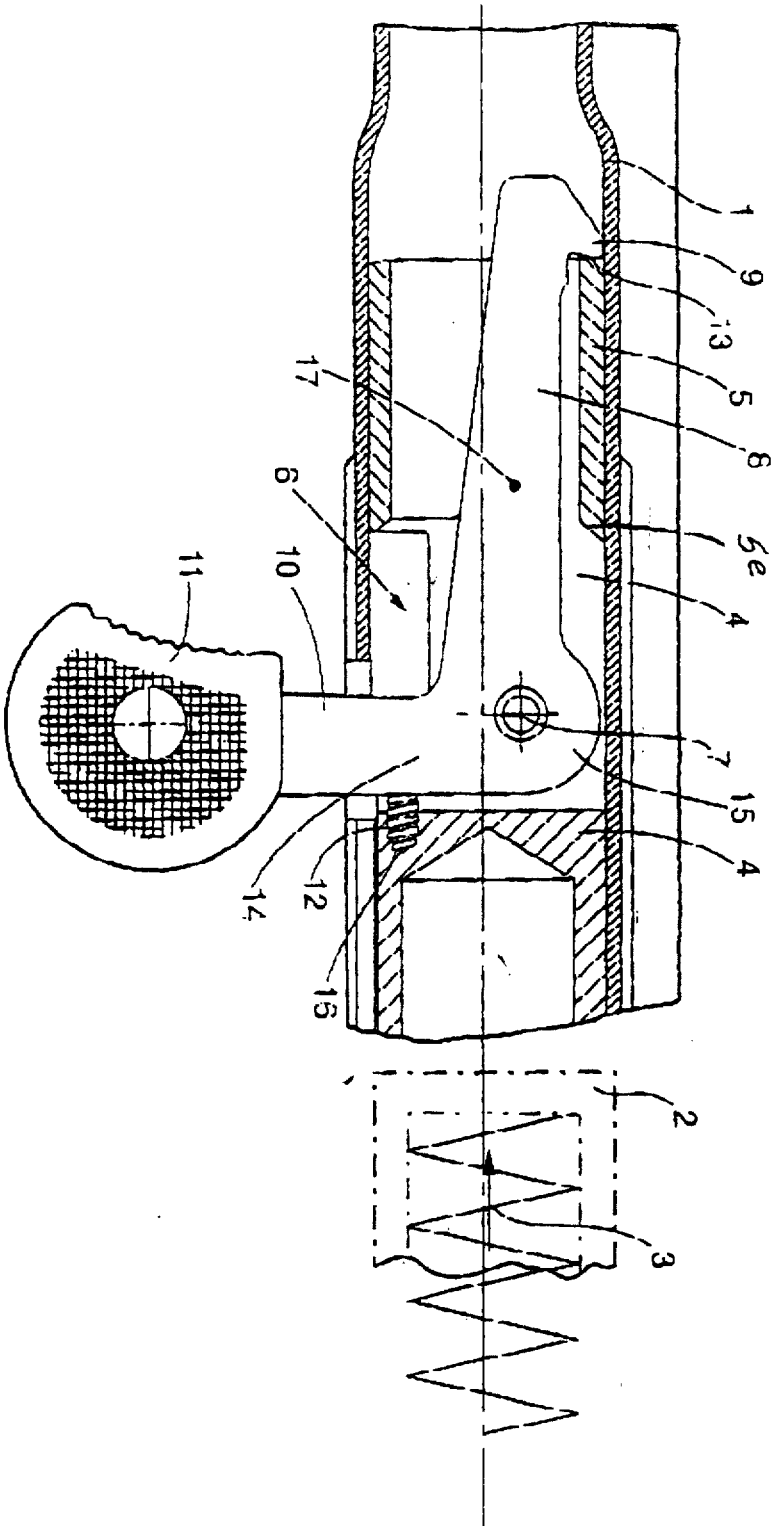

Turning now to the drawings, FIG. 1 shows an embodiment of a submachine gun constructed according to the present invention. The submachine gun includes a housing 1 with a longitudinally extending internal channel or opening which forms a guide. A bolt or breech block 2 and a tension slide element 4 have at least portions thereof mounted in this guide and adapted for sliding movement between a forward position and a rearward position as will be understood by those skilled in the art.

The tension slide element 4 is disposed closer to the front of the weapon than the bolt 2. The bolt 2, which is only shown schematically in FIG. 1, is normally biased in a forward position (the left direction in the drawing) by a recoil spring 3 (which is illustrated schematically by an arrow). When the tension slide element 4 and the bolt 2 are moved together backward and then released, the recoil spring 3 moves the bolt to the forward position. The bolt 2 in turn urges the tension slide 4 forward until it is stopped by engaging the end edge 5*e* of an annular sleeve 5. The sleeve 5 is preferably welded into the guide in the housing.

In accordance with the present invention, the tension slide element 4 has an interlocking hand lever 6 which is pivotally mounted on the tension slide element about an axis 7. In the preferred embodiment, the hand lever 6 is an angled lever with a first arm or shank 14 extending outwardly from one side of the pivot axis 7. A second arm or shank 8 extends from the pivot axis opposite the first arm 14, and is connected with the first arm by an angled section 15. The hand lever 6 is pivotally connected at its angled section 15 to the tension slide element 4. The first lever arm 14 extends generally transversely to the longitudinal axis of the guide and of the weapon. As illustrated in FIG. 1, the first lever arm 14 comprises a hand grip 10 protruding from the housing 1 of the weapon. A handle 11 is located at the end of the hand grip 10. The hand grip permits the operator of the weapon to manually move the tension slide element and the bolt to a rearward position so that a cartridge may be staged to load the weapon.

The second lever arm 8 extends forward generally in the longitudinal direction of the weapon. In the illustrated embodiment, the second lever arm 8 has a length that is significantly greater than that of the first arm 14. The end of the second arm 8 is formed into a hook-type latch 9 which extends in a direction opposite to the hand grip 10. As shown in FIG. 1, the side edge 8*e* of the lever arm 8 opposite to the latch 9 may be tapered for increased structural integrity.

The latch 9 is arranged in such a way that it retentively engages the forward facing end surface 13 of the sleeve 5 when the tension slide element 4 abuts the rear end 5*r* of the sleeve. In this way, the latch interlockingly retains the angled lever and therewith the tension slide element in the forward position. In the preferred embodiment, the latch 9 is disposed at the distal end of the second arm 8 for engaging the front end of the sleeve 5. It will be appreciated, however, that the latch may be arranged at other positions on the hand lever for engaging a corresponding stop surface provided in the housing.

FIG. 1 also shows a pressure spring 12 which is partially received in a receiving bore 16 formed into a forward facing surface of the tension slide element 4. The spring 12 is preferably a helical spring which is secured in the receiving bore 16. The receiving bore 16 is disposed proximate to the bottom wall of the housing 1 and has its axis parallel with the direction of movement of the tension slide element 4. The pressure spring 12 presses against the back of the hand grip 10, thereby urging the angled lever 6 to pivot toward its latching position where the latch 9 engages the sleeve stop surface 13.

To load the weapon, the handle 11 is grasped by the operator of the weapon and drawn in the rearward direction of the weapon (the right direction in the drawing). The angled lever 6 is unlatched when the angled lever 6 is sufficiently pivoted so that the latch 9 disengages the end 13 of the sleeve 5. The tension slide element 4 together with the bolt 2 is thus moved rearward by the operator by means of the handle 11.

When the bolt 2 has reached its rear end position, a cartridge (not shown) is staged in an appropriate position for charging. The handle 11 is then released, and the recoil spring 3 pushes the bolt and the tension slide element 4 together toward the front of the weapon. After the tension slide element 4 is stopped by abutment against the rear-facing end of the sleeve 5, the lever 6 rotates under the pressure of the pressure spring 12. The latch 9 is thereby rotated into interlocking engagement with the forward-facing end surface 13 of the sleeve. The latch 9 is then held in the latching position by the force exerted by the pressure spring 12 on the angled lever 6.

It will be appreciated that by directly mounting the latch 9 on the tension slide element 4, the latch securely holds the tension slide element in the forward position. The problem of the jamming of cartridge loading experienced by prior art weapons as described above is thus virtually completely eliminated.

One particular feature of a preferred embodiment of the present invention is the inclusion of the latch 9 and the hand grip 10 in a hand lever. By virtue of this arrangement, the engagement and release of the latching mechanism does not require any separate or additional handling by the operator of the weapon. When the operator of the weapon grasps and pulls back the hand grip 10 to manually load the weapon, the latching mechanism is automatically disengaged. When the hand grip 10 is released, the tension slide element 4 is returned to its front end position and the latching mechanism is then automatically engaged. Thus, the self-loading weapon of the present invention is at least as easy to operate as prior art weapons in the same category, while effectively eliminating the primary source of the jamming problems.

In accordance with an advantageous execution of the present invention, the second arm 8 that carries the latch 9 is made to be considerably longer than the first arm 14 which carries the handle 10. Lengthening the second arm 8 increases the angular moment of inertia of the angled lever 6, thereby making it less likely to be swung out of the latching position by the jolting that occurs during the firing of the weapon. As shown in FIG. 1, the latch arm center of gravity (denoted by the numeral 17) is located at approximately the midpoint of the second level arm 8. Furthermore, increasing the length of the second lever arm 8 increases the mechanical advantage, thereby reducing the holding force required to hold the latch in its latching position.

To further reduce the susceptibility of the lever 6 to jolting, the pivot point 7 of the angled lever and the center of gravity 17 of the second arm 8 preferably are arranged along the line of the movement of the tension slide element 4 as illustrated in FIG. 1. Moreover, the handle 10 arranged on the first arm 14 of the lever is preferably made of plastic so as to contribute as little as possible to the inertial forces which could disturb the latching of the lever. For the same reason, the entire tension slide element 4 is preferably formed of plastic.

It is another advantageous execution of the present invention to utilize the housing structure which forms the front end stop for the tension slide element 4 as part of the latching mechanism. More particularly, the sleeve 5 which serves as the front end stop for the tension slide element 4 is also used for engaging the latch 9. This arrangement simplifies the construction of the weapon because only the length of the sleeve 5, i.e., the distance between its rear end surface and its front end surface, has to be controlled to closely fit the separation between the front end of the tension slide element 4 and the latch 9. The close tolerance for such an arrangement can be easily obtained to ensure the trouble-free operation of the latching mechanism.

As described above, the bolt 2 is mounted in the housing 1 of the weapon for sliding movement and is biased in the forward direction by the recoil spring 3. During shooting operation, the tension slide element 4 is held in its front position by the latch 9, while the bolt 4 recoils after each shot and is then driven forward by the recoil spring 3 until it is stopped by impacting on the tension slide. Such impact does not help to ensure the security of the latching. On the contrary, there is a danger that the jarring by the impact forces applied to the tension slide element 4 could cause the pivotally mounted hand grip 10 to bounce and disengage the latch 9 from the sleeve front end stop 13. In order to improve the engagement of the latch 9, the pressure spring 12 is used to apply a torque on the angled lever 6 to constantly urge the latch into its latched position. In this way, the latch 9 is prevented from disengagement even with the jarring experienced during the continuous firing of the weapon.

While the invention is susceptible of various modifications and alternative constructions, certain illustrated embodiments hereof have been shown in the drawings and have been described. It should be understood, however, that there is no intention to limit the invention to the specific forms disclosed, but, on the contrary, the invention is to cover all modifications, alternative constructions and equivalents falling within the spirit and scope of the invention as defined by the appended claims.

What is claimed is:

1. A self-loading weapon comprising:

a housing providing a longitudinally extending guide having a forward position and a rearward position;

a bolt including at least a portion seated in the guide for sliding movement;

a tension slide element seated in the guide adapted for sliding movement between the forward position and the rearward position;

a recoil spring coupled to the bolt for normally biasing the bolt and the tension slide element in the forward position; and a hand lever mounted to the tension slide element about a pivot, the hand lever having a grip end protruding from the housing for manually moving the tension slide element in the housing and, a latch disposed thereon inside the housing, the hand lever being pivotable to a latched position when the tension slide element is in the forward position so that the latch retentively engages a detent formed in the housing, the hand lever being counter-rotatable to an unlatched position to disengage the latch from the detent to permit movement of the tension slide element in the rear direction.

2. The invention as in claim 1, wherein the hand lever is an angled lever having a first arm and a second arm joined by an angled section, the first arm having an end extending through the housing of the weapon to form the grip end, the latch being located on the second arm of the angled lever.

3. The invention as in claim 2, wherein the angled lever has a handle attached to the grip end, the latch being disposed on a forward end of the second arm, the angled lever being pivotally connected at its angled section to the tension slide element.

4. The invention as in claim 3, wherein the second arm of the angled lever is substantially longer than the first arm and extends generally in the longitudinal direction of the housing.

5. The invention as in claim 3, wherein the pivot of the lever and a center of gravity of the second arm are arranged along a line of movement of the tension slide element in the housing.

6. The invention as in claim 3, wherein the handle is formed of plastic.

7. The invention as in claim 3, wherein the tension slide element is formed of plastic.

8. The invention as in claim 3, wherein the detent is formed on a stop member which prevents forward movement of the tension slide element at its front position.

9. The invention as in claim 1, further including a pressure spring mounted on the tension slide element and coupled to the hand lever to urge the hand lever into the latched position.

10. An interlock member adapted for use in a self-loading weapon including a longitudinally extending housing defining forward and rearward directions, a bolt received in the housing for sliding movement, a tension slide received in the housing for sliding movement between a front position and a rear position, and a recoil spring coupled to the bolt for normally biasing the bolt in pushing engagement with the tension slide in the forward direction, the interlock member comprising:

a hand lever pivotally mounted on the tension slide about a pivot point, the hand lever having a first shank extending from the pivot point through the housing for permitting manual engagement of the hand lever and a second shank extending from the pivot point toward a stop surface provided by the weapon housing, the second shank having a latch disposed thereon for engaging the stop surface, the hand lever being pivotable to a latched position where the latch engages the stop surface to prevent longitudinal movement of the tension slide, the latch being pivotable to an unlatched position to permit longitudinal movement of the tension slide.

* * * * *

UNITED STATES PATENT AND TRADEMARK OFFICE

CERTIFICATE OF CORRECTION

PATENT NO. : 5,700,967

DATED : December 23, 1997

INVENTOR(S) : Manfred Gühring

It is certified that error appears in the above-identified patent and that said Letters Patent is hereby corrected as shown below:

The title page, should be deleted and substitute therefor the attached title page:

Delete Figure 1, and substitute therefor the Figure, consisting of Fig. 1, as shown on the attached pages.

Signed and Sealed this

First Day of September, 1998

Bruce Lehman

*Attest:*

BRUCE LEHMAN

*Attesting Officer*

*Commissioner of Patents and Trademarks*

United States Patent [19]

Gühring

[11] Patent Number: 5,700,967

[45] Date of Patent: Dec. 23, 1997

[54] INTERLOCKING MECHANISM FOR A SELF-LOADING WEAPON

[75] Inventor: Manfred Gühring, Beffendorf, Germany

[73] Assignee: Heckler & Koch GmbH, Germany

[21] Appl. No.: 762,378

[22] Filed: Dec. 6, 1996

[30] Foreign Application Priority Data

Dec. 7, 1995 [DE] Germany ..... 195 45 774.9

[51] Int. Cl.[6] ..... F41A 17/00; F41A 7/00

[52] U.S. Cl. ..... 89/1.42; 89/11

[58] Field of Search ..... 89/1.42, 9, 11

[56] References Cited

U.S. PATENT DOCUMENTS

| | | | |
|---|---|---|---|
| 3,786,716 | 1/1974 | Wilson | 89/9 X |
| 5,225,625 | 7/1993 | Rochelle et al. | 89/9 |
| 5,231,243 | 7/1993 | Lescure | 89/9 |

FOREIGN PATENT DOCUMENTS

| | | |
|---|---|---|
| 501820 | 7/1930 | Germany . |
| 309602 | 9/1955 | Netherlands . |

*Primary Examiner*—Michael J. Carone
*Assistant Examiner*—Matthew J. Lattig
*Attorney, Agent, or Firm*—Leydig, Voit & Mayer, Ltd.

[57] ABSTRACT

A self-loading weapon includes a bolt and a tension slide slidably mounted in the housing of the weapon, and an interlocking mechanism for securely locking the tension slide in its front end position during the shooting operation of the weapon. The interlocking mechanism comprises an angled lever which is pivotally connected to the tension slide. One arm of the angled lever is formed as a hand grip protruding from the weapon for manually moving the tension slide and the breech block. A second arm of the angled lever has a latch formed thereon for engaging a stop formed in the housing when the tension slide is in its front end position to prevent the tension slide from rearward movement.

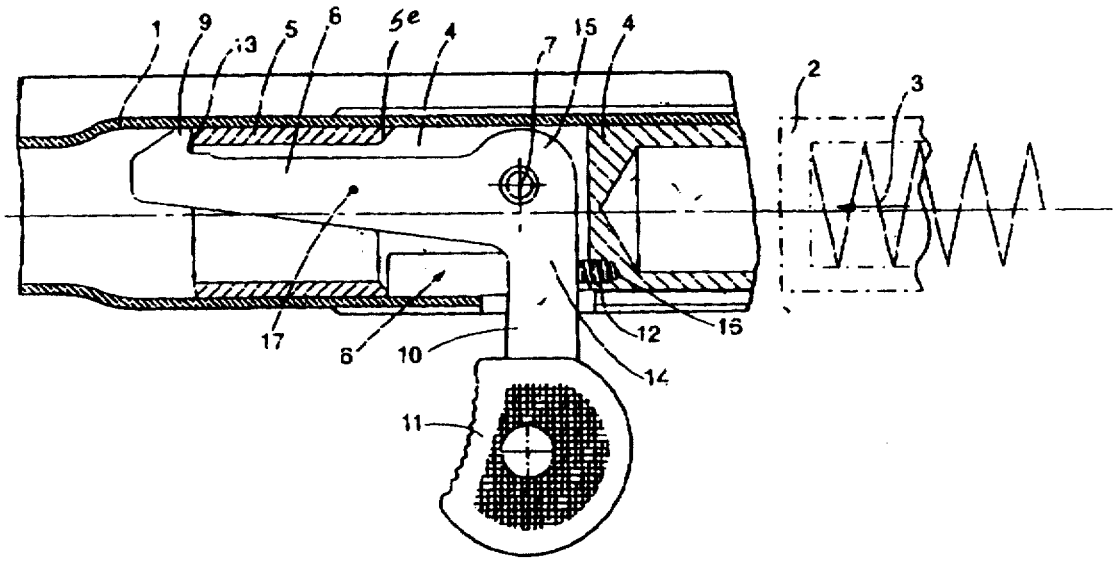

10 Claims, 1 Drawing Sheet